US010571827B2

(12) United States Patent
Sakai et al.

(10) Patent No.: US 10,571,827 B2
(45) Date of Patent: Feb. 25, 2020

(54) DEVELOPER REPLENISHING DEVICE, DEVELOPER DEVICE, AND IMAGE FORMING DEVICE HAVING A VIBRATION PLATE THAT ENGAGES AN AGITATION MEMBER

(71) Applicant: Konica Minolta, Inc., Chiyoda-ku, Tokyo (JP)

(72) Inventors: Tetsuya Sakai, Toyokawa (JP); Syuichi Katogi, Toyokawa (JP); Takeru Kinoshita, Toyokawa (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/103,276

(22) Filed: Aug. 14, 2018

(65) Prior Publication Data

US 2019/0056681 A1 Feb. 21, 2019

(30) Foreign Application Priority Data

Aug. 16, 2017 (JP) ..... 2017-157258

(51) Int. Cl.
*G03G 15/08* (2006.01)

(52) U.S. Cl.
CPC ..... *G03G 15/0889* (2013.01); *G03G 15/0877* (2013.01); *G03G 15/0879* (2013.01); *G03G 2215/085* (2013.01)

(58) Field of Classification Search
CPC ..... G03G 15/0889; G03G 15/0822; G03G 15/0877; G03G 2215/0802; G03G 2215/085
USPC ..... 399/256, 258, 261
See application file for complete search history.

(56) References Cited

U.S. PATENT DOCUMENTS 10,018,941 B2 * 7/2018 Tomita ..... G03G 15/0889
2006/0222408 A1 * 10/2006 Suenami ..... G03G 15/0822 399/254
2010/0143011 A1 * 6/2010 Tawada ..... G03G 21/007 399/358

(Continued)

FOREIGN PATENT DOCUMENTS

JP 62075567 A 4/1987
JP 11305532 A * 11/1999

(Continued)

*Primary Examiner* — Robert B Beatty
(74) *Attorney, Agent, or Firm* — Cantor Colburn LLP

(57) ABSTRACT

A device that replenishes developer to a developer unit and includes a storage for storing developer, an agitation member, and a vibration plate. The agitation member has a blade shape and is rotationally driven to agitate the developer in the storage. The vibration plate extends from a top portion towards a bottom portion of the storage along a rotation direction of the agitation member, and includes a vibration portion that vibrates due to contact with the agitation member undergoing rotation. A top end of the vibration plate is fixed and a bottom end of the vibration plate is a free end, and there is a gap between the vibration portion and an inner wall of the storage. The vibration plate is provided with an engagement protrusion towards the free end that engages with the agitation member and causes the agitation member undergoing rotation to deform then spring back.

11 Claims, 10 Drawing Sheets

(56) References Cited

U.S. PATENT DOCUMENTS

2016/0342129 A1* 11/2016 Matsumoto ..... G03G 21/0011

FOREIGN PATENT DOCUMENTS

| | | | | |
|---|---|---|---|---|
| JP | 2000155457 | A | | 6/2000 |
| JP | 2006058756 | A | * | 3/2006 |
| JP | 2008216360 | A | | 9/2008 |
| JP | 2013044932 | A | * | 3/2013 |
| JP | 2016145923 | A | | 8/2016 |
| JP | 2017151420 | A | * | 8/2017 |

* cited by examiner

DEVELOPER REPLENISHING DEVICE, DEVELOPER DEVICE, AND IMAGE FORMING DEVICE HAVING A VIBRATION PLATE THAT ENGAGES AN AGITATION MEMBER

CROSS-REFERENCE TO RELATED APPLICATIONS

The present application claims priority under 35 U.S.C. § 119 to Japanese patent application No. 2017-157258, filed on Aug. 16, 2017, and the entire disclosure of which is incorporated herein by reference.

BACKGROUND

Technical Field

The present invention relates to developer replenishing devices that replenish developer used in electrophotographic systems, developer devices including such developer replenishing devices, image forming devices including such developer devices, and in particular to technology for preventing agglomeration of developer in developer storage units of developer replenishing devices.

Description of Related Art

In an electrophotographic image forming device such as a copying machine or printer, toner (developer) is supplied from a developer unit to an electrostatic latent image formed on photoreceptors to visualize the electrostatic latent image, and after transferring the toner image onto a recording sheet, image formation is performed by thermal fixing by a fixing unit.

Typically, in such an image forming device, a replaceable toner bottle having a large capacity is attachable and detachable. A toner replenishing device is disposed below this toner bottle to replenish an amount of toner consumed by the developer unit to the developer unit, in order to maintain a constant toner concentration in the developer unit.

FIG. 11 is a schematic diagram illustrating an example of a conventional toner replenishing device.

A toner replenishing device 530 includes a toner hopper 531 (developer storage) for storing toner supplied from a toner bottle 520 and a detector (not illustrated) for detecting the amount of toner in the toner hopper 531. When the amount becomes equal to or less than a defined amount, the toner replenishing device 530 receives toner supplied from the toner bottle 520.

Toner falls from the toner bottle 520 under its own weight through a discharge port 521 and is supplied into the toner hopper 531 from a toner supply port 522 provided in an upper portion of the toner replenishing device 530. Toner stored in the toner hopper 531 flows into a conveyance pipe 533 while being agitated by an agitating blade 532, is transported in an axial direction by a conveyance screw 535, and replenishes toner in a developer unit (not illustrated) located below the toner hopper 531 via a toner replenishing port 534.

Because of the shape of the toner hopper 531, there is a region that cannot be agitated by the agitating blade 532, but such a region is located upwards and therefore in normal use, even if the agitating blade 532 does not reach the region, toner in the region falls under its own weight and is agitated by the agitating blade 532.

However, in a toner replenishing device for a color for which consumption is low in an image forming device capable of color printing, or a toner replenishing device for which image formation has not been performed for a long period of time, bulk density increases and toner agglomerates as time passes, and the toner settles and agglomerates at a bottom portion (region D) of the toner hopper 531 and regions that the agitator cannot agitate, in particular a region near the toner supply port 522 (region C). Further, toner may also agglomerate in a region E in contact with the agitating blade 532.

As a result, it becomes difficult to maintain a regular toner supply to the developer unit regardless of whether there is a sufficient amount of toner remaining in the toner hopper 531, it becomes difficult to maintain toner concentration in the developer unit, and stable image quality cannot be achieved.

In view of this, in the invention described in JP 2016-145923, for example, a wire spring is disposed below a toner supply port to which toner is supplied from a toner bottle, and the wire spring is pushed and swung by rotation of an agitating blade in order that toner agglomerating such that it blocks the toner supply port (toner bridging) is broken up.

However, according to the toner replenishing device described in JP 2016-145923, even though toner bridging in the vicinity of the toner supply port can be prevented, it is not possible to help fluidize toner agglomerated at a bottom portion of the toner storage.

Further, JP S62-75567, JP 2000-155457, and JP 2008-216360 also describe configurations for preventing toner adhesion to a wall surface in a toner replenishing device and for suppressing toner bridging, but do not provide a sufficient effect of increasing toner fluidity in a toner replenishing device.

SUMMARY

The present invention was made in view of the above circumstances, and an aim of the present invention is to provide a developer replenishing device that can effectively prevent agglomeration of developer in a developer storage and stably supply developer while having a very simple configuration.

Further, the present invention aims to provide a developer device and an image forming device that each include the developer replenishing device.

In order to achieve at least one of the aims described above, a developer replenishing device reflecting one aspect of the present invention is a developer replenishment device that replenishes developer to a developer unit, the developer replenishment device comprising: a storage for storing developer; an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, and the vibration plate is provided with an engagement protrusion disposed towards the free end of the vibration plate, the engagement protrusion engaging with the agitation member and causing the agitation member undergoing rotation to deform then spring back.

Further, a developer device reflecting one aspect of the present invention is a developer device comprising: a developer unit; and a developer replenishment device that supplies developer to the developer unit, the developer replenishment device comprising: a storage for storing developer; an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, and the vibration plate is provided with an engagement protrusion disposed towards the free end of the vibration plate, the engagement protrusion engaging with the agitation member and causing the agitation member undergoing rotation to deform then spring back.

Further, an image forming device reflecting one aspect of the present invention is an image forming device comprising: a developing device; a transfer unit for transferring an image formed by the developing device onto a recording sheet; and a fixing unit for fixing onto the recording sheet the image transferred by the transfer unit, wherein the developing device comprises: a developer unit; and a developer replenishment device that supplies developer to the developer unit, the developer replenishment device comprising: a storage for storing developer; an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, and the vibration plate is provided with an engagement protrusion disposed towards the free end of the vibration plate, the engagement protrusion engaging with the agitation member and causing the agitation member undergoing rotation to deform then spring back.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the invention. In the drawings.

DETAILED DESCRIPTION

An image forming device pertaining to an embodiment of the present invention is described below with reference to the drawings. However, the scope of the invention is not limited to the disclosed embodiment.

(1) Overall Structure of Image Forming Device

Figure 1:
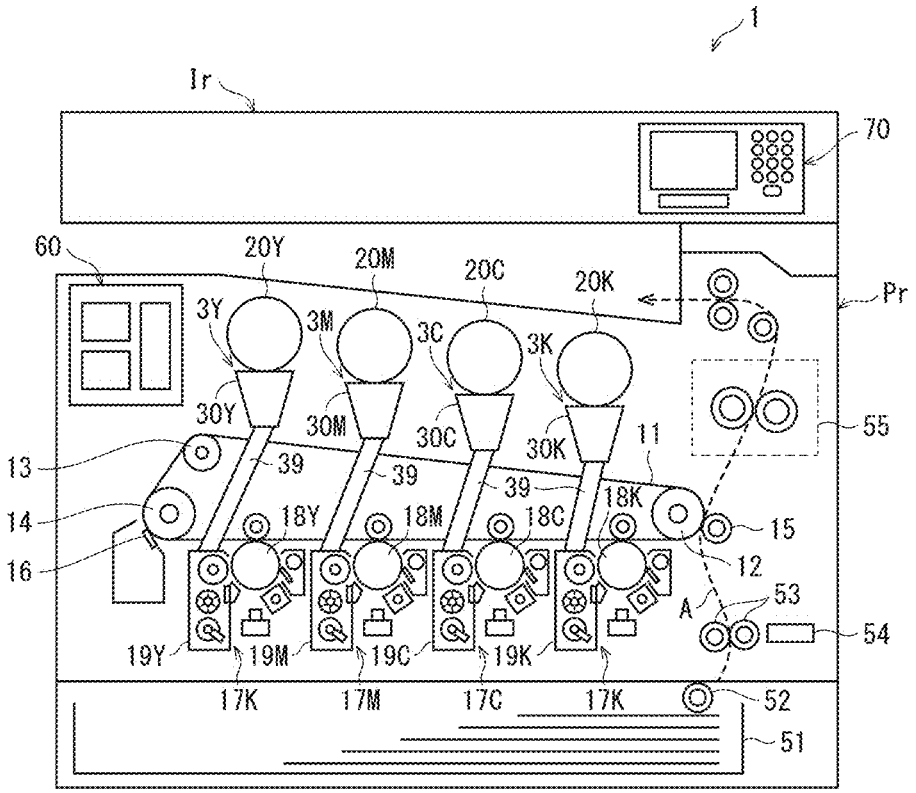
FIG. 1 is a schematic diagram indicating an example of an image forming device pertaining to the present invention.

FIG. 1 is a schematic diagram indicating an example of an image forming device pertaining to the present invention. In the following description, directions such as up, down, left, right, clockwise, counterclockwise, and the like reference FIG. 1 unless otherwise stated.

An image forming device 1 illustrated in FIG. 1 is a tandem-type color digital copy machine that includes an image reader Ir for reading a document image, a printer Pr for printing a read image on a recording sheet, an operation panel 70 on which a user can input print conditions and the like, and which displays device operation status and user input results, and a controller 60 that controls operations of the printer Pr, the image reader Ir, and the operation panel 70.

The image reader Ir reads a document placed on a document glass plate (not shown) by moving a scanner, and has a publicly known configuration. The image reader Ir separates a source image into three colors, red (R), green (G), and blue (B), and converts this into an electric signal by using an image sensor such as a charge-coupled device (CCD) to obtain R, G, and B image data.

R, G, and B image data obtained by the image reader Ir is subjected to various processing such as edge emphasis processing and smoothing processing by the controller 60, then converted to yellow (Y), magenta (M), cyan (C), and black (K) reproduction color image data and stored in a recording unit (memory) of the controller 60.

Reproduction color image data stored in the memory of the controller 60 is read out one scan line at a time and becomes a drive signal of a light emitting source such as a light emitting diode in an exposure unit.

The printer Pr forms an image on a recording medium such as a recording sheet via an electrophotographic method. The printer Pr includes imaging units 17Y, 17M, 17C, 17K (hereinafter also referred to as "imaging units 17" in some instances) that form images based on yellow (Y), magenta (M), cyan (C), and black (K) reproduction color image data.

The basic configuration of the imaging units 17 is the same. Chargers, exposure units, developer units 19Y, 19M, 19C, 19K (hereinafter also referred to as "developer units 19" in some instances), transfer rollers, and cleaning units are disposed around photoreceptor drums 18Y, 18M, 18C, and 18K (hereinafter also referred to as "photoreceptor drums 18" in some instances), which rotate clockwise.

Operation of one of the imaging units 17 is described below. An electrostatic latent image is formed on a surface of a photoreceptor drum 18 by a charger and an exposure unit, based on corresponding reproduction color image data. The electrostatic latent image is visualized as a toner image by supplying developer (toner) to the surface of the photoreceptor drum 18 from a developer unit 19.

The toner image formed on the photoreceptor drum 18 is transferred to an intermediate transfer belt 11 that passes between the photoreceptor drum 18 and a transfer roller (this may also be referred to as a primary transfer). In order that toner images of each color of developer are transferred to overlap on the same position of the intermediate transfer belt 11, timing of image forming by each of the imaging units 17Y, 17M, 17C, 17K is staggered.

Toner that remains on the photoreceptor drum 18 is scraped off by a cleaning unit.

The intermediate transfer belt 11 is tensioned between a drive roller 12, a tension roller 13, and a driven roller 14. The tension roller 13 is biased upward by a biasing member (for example, a spring) that is not illustrated, and thereby applies a defined tensioning force on the intermediate transfer belt 11. The intermediate transfer belt 11 is rotated counterclockwise by the drive roller 12.

The drive roller 12 is pressed against a secondary transfer roller 15 with the intermediate transfer belt 11 sandwiched therebetween. At a position opposite the driven roller 14, a cleaning blade 16 that scrapes off toner remaining on the intermediate transfer belt 11 is pressed against a surface of the intermediate transfer belt 11.

Under the intermediate transfer belt 11, the imaging units 17Y, 17M, 17C, 17K of yellow (Y), magenta (M), cyan (C), and black (K) reproduction colors are disposed in this order with defined intervals therebetween.

The printer Pr, through accurate overlapping transfer (primary transfer) of yellow (Y), magenta (M), cyan (C), and black (K) toner images from the imaging units 17Y, 17M, 17C, 17K to the intermediate transfer belt 11, generates a color toner image on the surface of the intermediate transfer belt 11. The color toner image is then transferred (secondary transfer) onto a recording sheet (transfer sheet).

The recording sheet is supplied from a paper cassette 51, a sheet feed roller 52 feeding an uppermost sheet to a conveyance path (broken line A) to be conveyed to resist rollers 53. The resist rollers 53 are synchronized to rotation of the intermediate transfer belt 11 and convey the recording sheet to a nip between the drive roller 12 and the secondary transfer roller 15.

When the recording sheet passes through the nip between the drive roller 12 and the secondary transfer roller 15, the recording sheet comes into direct contact with the intermediate transfer belt 11, and the toner image on the intermediate transfer belt 11 is transferred to the recording sheet (secondary transfer).

The recording sheet on which the toner image has been transferred is conveyed to a fixing unit 55. In the fixing unit 55, heat and pressure fixes the toner image on the recording sheet. The recording sheet on which the toner image has been fixed is then discharged outside the device. Residue toner that remains on the intermediate transfer belt 11 without being transferred is scraped off by the cleaning blade 16 and stored in a waste toner box.

The developer units 19 of the imaging units 17 are provided with toner hoppers (toner storage) 30Y, 30M, 30C, 30K (hereinafter also referred to as "toner hoppers 30" in some instances) that store corresponding colors of toner and are connected to the developer units 19 via tubular replenishing pipes 39.

When toner concentration in a developer unit 19 decreases, toner is supplied from a toner hopper 30 to the developer unit 19, according to toner replenishing devices described later. Toner bottles (developer storage bottles) 20Y, 20M, 20C, 20K (hereinafter also referred to as "toner bottles 20" in some instances) are attachable and detachable and disposed above the toner hoppers.

When remaining toner in a toner hopper 30 is low, toner is supplied from a toner bottle 20 to the toner hopper 30. When toner in the toner bottle 20 runs out, the toner bottle 20 can be replaced with a toner bottle 20 filled with toner.

The toner bottles 20 are each cylindrical bottles with a helical ridge formed on an inner circumferential surface, for example. By rotation of the toner bottles 20, toner therein drops from a discharge port provided at an end portion in the longitudinal direction of the toner bottles 20, the toner entering the toner hoppers 30 via toner supply ports 311 of toner replenishing devices 3.

(2) Configuration of Toner Replenishing Device

The following is a description of a toner replenishing device, a key element of the present invention.

Figure 2:
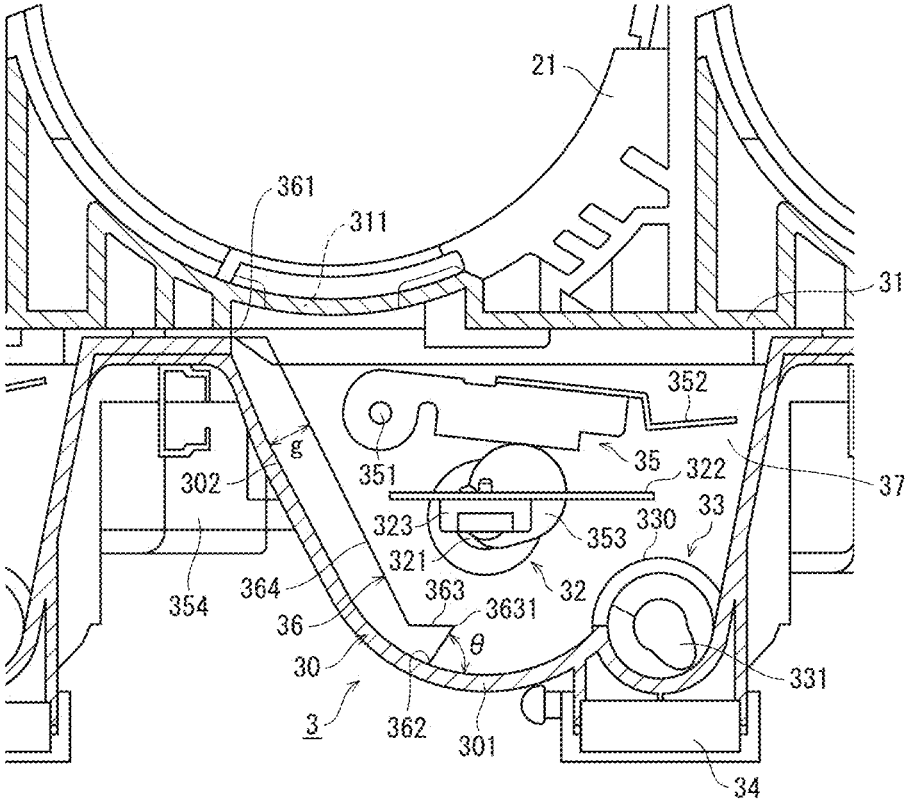
FIG. 2 is a cross-section diagram of an example of a toner replenishing device pertaining to the present invention taken along a plane perpendicular to a rotation axis of an agitation member.
Figure 3:
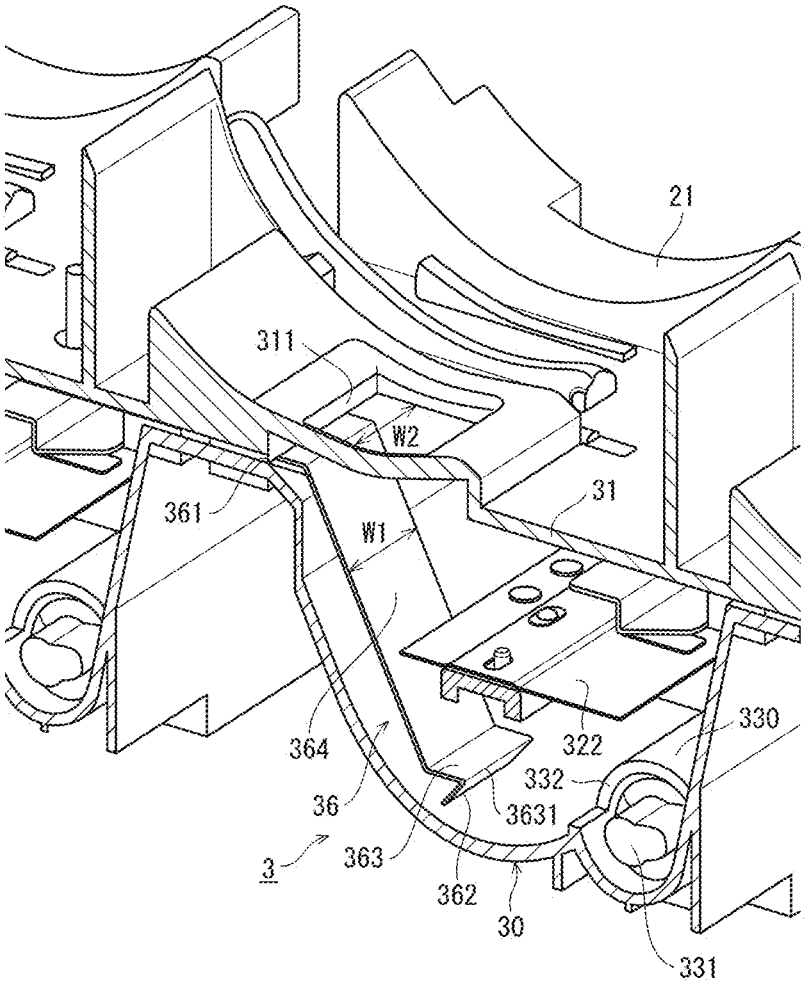
FIG. 3 is a perspective view diagram of an example of a toner replenishing device pertaining to the present invention taken along a plane perpendicular to a rotation axis of an agitation member.

FIG. 2 is a cross-section diagram of an example of a toner replenishing device 3 pertaining to the present invention taken along a plane perpendicular to a rotation axis of an agitation member, and FIG. 3 is a perspective view diagram of the toner replenishing device 3 illustrated in FIG. 2 taken along substantially the same plane.

In FIG. 2 and FIG. 3, the toner replenishing device 3 includes the toner hopper 30, an agitator 32, a toner conveyor 33, a toner amount detector 35, and a vibration plate 36.

The toner hopper 30 includes a pair of opposing flat side surface portions 37 (in FIG. 4, the side surface portion 37 nearest the reader is cut away and not visible), a bottom surface portion 301 connected to the side surface portions 37 whose top portion widens outwards and whose bottom portion is substantially cylindrical, and a lid portion 31 that covers an upper portion of the toner hopper 30.

Although the pair of the side surface portions 37 are parallel and are each orthogonal to the bottom surface portion 301, the present invention is not limited to this example, and can be widely applied to configurations that can hold supplied toner.

The lid 31 is formed integrally with a toner bottle holder 21 for attachment of a toner bottle 20 (not illustrated in FIG. 2, FIG. 3). A toner supply port 311 for receiving toner dropped and discharged from the discharge port is provided to the lid 31 right under the discharge port of the toner bottle 20. That is, when the toner bottle 20 is rotated, toner dropped from the discharge port is supplied to the toner hopper 30 via the toner supply port 311.

According to the present embodiment, for ease of manufacturing and assembly and for device miniaturization, the toner hoppers 30 for reproduction colors yellow (Y), magenta (M), cyan (C), and black (K) are integrally connected to each other. Similarly, the toner bottle holder 21 connected to the lid 31 is integrally connected to other toner bottle holders 21 such that the toner bottle holders 21 for yellow (Y), magenta (M), cyan (C), and black (K) are integrally connected to each other.

An inclined surface 302 sloping inwards is formed right under the toner supply port 311 of the toner hopper 30.

The agitator 32 includes a rotation shaft 321 and an agitation blade 322 (agitation member). The rotation shaft 321 is orthogonal to the opposed side surface portions 37 of the toner hopper 30, and is rotatably supported by the side surface portions 37. The agitation blade 322 includes a flexible resin film (for example, a polyethylene terephthalate (PET) film) and is attached to the rotation shaft 321 via an attachment member 323.

The rotation shaft 321 protrudes outside the toner hopper 30 and is connected to a driving device (for example, a motor) (not illustrated) that imparts a rotational force. Through rotation of the rotation shaft 321, the agitation blade 322 rotates inside the toner hopper 30. As a result, the agitation blade 322 can agitate toner in a range (rotation region B: see FIG. 5A) of a rotating body (for example, a cylindrical shape) having a radius of a distance from an axis of the rotation shaft 321 to a furthest point of the agitation blade 322 (tip of agitation blade 322).

The bottom surface portion 301 of the toner hopper 30 has an inner wall surface that follows a circumferential surface of a cylinder truncated into a horizontal cylindrical segment, and therefore the agitation blade 322 can smoothly agitate toner in the vicinity of the bottom surface portion 301.

Figure 4:
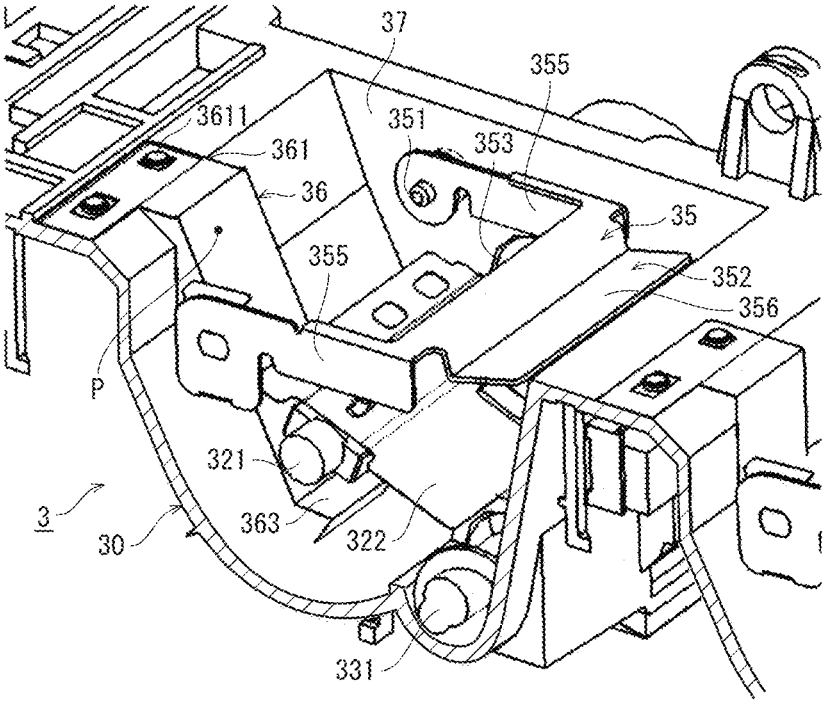
FIG. 4 is a perspective view diagram for illustrating an interior of the toner replenishing device of FIG. 3 when a toner bottle holder is removed.

FIG. 4 is a cross-section perspective view diagram for more specific illustration of internal configuration of the toner replenishing device 3. For convenience of explanation, the toner bottle holder 21 to which the toner bottle 20 is attached and the lid 31 are not illustrated in FIG. 4.

The toner amount detector 35 includes a detection plate 352, an eccentric cam 353, and a detection sensor 354. The detection plate 352 has an approximate "U" shape in plan view in which two arm portions 355 are connected to each other by a flat plate portion 356. Ends of the arm portions 355 are attached to the side surface portions 37 of the toner hopper 30 via support shafts 351 so as to be able to swing.

The eccentric cam 353 is fixed to the rotation shaft 321 of the agitator 32 and rotates with the rotation shaft 321 in an eccentric state. One of the arm portions 355 of the detection plate 352 is in contact with the eccentric cam 353. When the arm portion 355 of the detection plate 352 abuts the eccentric cam 353, the detection plate 352 repeatedly swings up and down about the support shafts 351 in accordance with rotation of the rotation shaft 321, but when the flat plate portion 356 of the detection plate 352 rests on a liquid surface of toner (a top surface of toner stored immediately below the flat plate portion 356) the flat plate portion 356 does not drop below that level.

The detection sensor 354 (see FIG. 2) detects position (more accurately inclination) of the detection plate 352 and is provided outside the toner hopper 30.

As the detection sensor 354, a photo interrupter is used according to the present embodiment. For example, an end portion of one of the support shafts 351 of the detection plate 352 protrudes from one of the side surface portions 37, and a light shielding member extending in a direction orthogonal to a direction of extension of the one of the support shafts 351 is attached to the end portion, the light shielding member being configured to swing in synchronization with swinging movement of the detection plate 352. When toner amount in the toner hopper 30 drops to a defined amount, position of the detection plate 352 becomes low and the light shielding member cuts off detection light of the photo interrupter, thereby detecting a toner near-empty state.

Further, according to another photo interrupter, when toner amount in the toner hopper 30 becomes equal to or greater than a defined amount and position of the detection plate 352 is high, the light shielding member cuts off detection light of the other photo interrupter, thereby detecting a toner full state.

However, the detection sensor 354 is not limited to this example, and any of a wide range of configurations capable of detecting position of the detection plate 352 can be adopted. For example, it is possible to use any of various known techniques such as detecting displacement of a detection plate due to a decrease in liquid level of toner by using a magnetic sensor.

Returning to FIG. 2, the toner conveyor 33 includes a conveyance pipe 330 and a conveyance screw 331. The conveyance pipe 330 is cylindrical and integrally molded at a position close to the bottom portion of the toner hopper 30.

Toner stored in the toner hopper 30 is agitated by the agitator 32, then flows into the conveyance pipe 330 via a first opening 332 (see FIG. 3) of the conveyance pipe 330, is conveyed in the axial direction by the conveyance screw 331, and falls from a second opening (not illustrated) into a replenishment port 34, to be supplied to the developer unit 19 via the replenishing pipe 39 (see FIG. 1).

A rotational force of the rotation shaft 321 of the agitator 32 is transmitted to a rotation axis of the conveyance screw 331 via gears or the like outside the toner hopper 30.

In the imaging unit 17, when toner concentration in the developer unit 19 becomes lower than or equal to a defined value, density of a toner image formed on the photoreceptor drum 18 decreases, causing deterioration in image quality of a final image fixed on a recording sheet.

Thus, the developer unit 19 coordinates with the toner replenishing device 3, and when toner concentration becomes lower than a defined amount, the developer unit 19 issues a toner replenishment request. The toner replenishing device 3 supplies toner to the developer unit 19 in response to a toner replenishment request.

That is, a magnetic sensor (toner concentration sensor (TCR)) is installed in a toner agitating portion in the developer unit 19 so that toner concentration in developer in the developer unit 19 can be detected.

According to the present embodiment, the developer unit 19 is a two-component developer type in which the developer includes a mixture of toner and a magnetic carrier. When toner is consumed by development, the proportion of carrier increases, and therefore the developer unit 19 acquires toner concentration in the developer unit 19 by detecting a toner/carrier ratio via the magnetic sensor.

When toner concentration falls equal to or below a defined threshold, the toner replenishing device 3 is driven to replenish toner, the agitation blade 322 is rotated, causing rotation of the conveyance screw 331, and while toner is agitated the toner is conveyed towards the first opening 332 of the conveyance pipe 330, toner in the toner hopper 30 is supplied to the developer unit 19. When toner concentration is returned to a defined reference value by this supply, the supply is stopped.

When toner amount remaining in the toner hopper 30 decreases and a toner near-empty state is detected by the detector 35, the toner bottle 20 is rotated by a drive mechanism (not illustrated), toner is supplied to the toner hopper 30, and toner amount in the toner hopper 30 increases. When a toner full state is detected, toner replenishment from the toner bottle 20 to the toner hopper 30 is stopped.

In the toner hopper 30 of the toner replenishing device 3, there is the vibration plate 36 for applying vibration and/or impact to toner agglomerated in the toner hopper 30 in order to improve toner flow.

(3) Form and Function of Vibration Plate 36

In FIG. 3, the vibration plate 36 is disposed directly below the toner supply port 311 of the lid 31 and extends from a top portion of the toner hopper 30 towards a bottom portion of the toner hopper 30. According to the present embodiment, the vibration plate 36 includes a stainless steel plate, has a thickness of 0.05 mm, has a width W1 equal to a width W2 of the toner supply port 311 (width in a direction parallel to the axis of the rotation shaft 321 of the agitation blade 322), which is, for example, approximately 13 mm, and is disposed such that positions of the vibration plate 36 and the toner supply port 311 coincide in the direction of the axis of the rotation shaft 321 of the agitation blade 322.

In FIG. 4, an upper end portion 361 of the vibration plate 36 is fixed to a top edge portion of the toner hopper 30 by a pin 3611, forming a fixed end. Note that the upper end portion 361 may be fixed by use of double-sided tape.

Towards a lower end portion 362 of the vibration plate 36, an engagement protrusion 363 is formed having a mountain fold shape (peak shape) pointing towards the interior of the toner hopper 30.

Returning to FIG. 2, the lower end portion 362 of the vibration plate 36 is merely in contact with an inner wall of the toner hopper 30 and is not fixed (hereinafter also referred to as a "free end" in some instances). A contact portion between the lower end portion 362 and the inner wall of the toner hopper 30, as well as a ridge line 3631 (fold at peak) of the engagement protrusion 363 are preferably parallel with the axis of the rotation shaft 321 of the agitator 32. An angle θ between an outer surface of the lower end portion 362 and the inner wall surface of the bottom surface portion 301 of the toner hopper 30 is set to an appropriate value equal to or less than 90°, for example 73°.

Figure 5A:
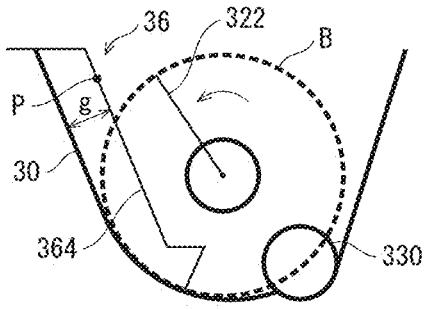
FIG. 5A to FIG. 5F are diagrams illustrating how an agitation member comes into contact with a vibration plate, engages with an engagement protrusion, deforms, and springs back, due to rotation of the agitation member.

Between a central portion 364 (vibration portion) between the upper end portion 361 and the engagement protrusion 363 of the vibration plate 36 and the inner wall surface of the toner hopper 30 is a gap g equal to or greater than a defined value (see FIG. 5A).

Figure 11:
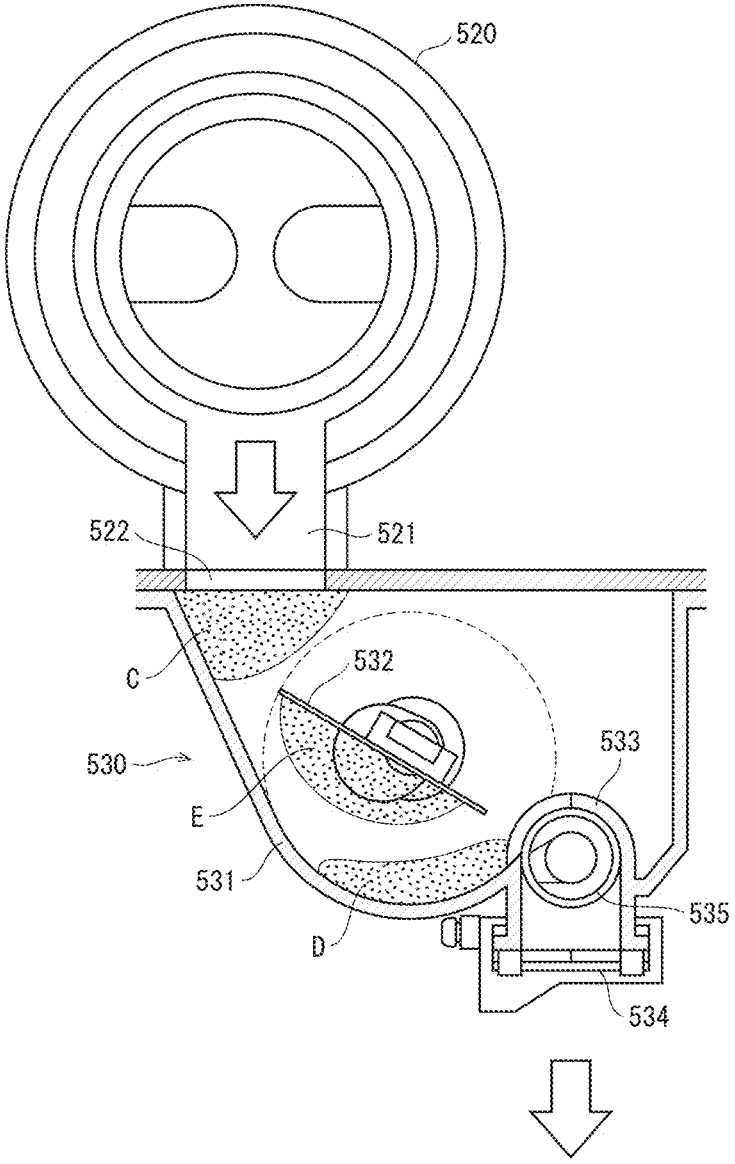
FIG. 11 Prior Art
FIG. 11 is a diagram illustrating portions of a toner storage where toner tends to agglomerate in a conventional toner replenishing device.

As described above, in the toner replenishing device 3, there is a portion not reached by the agitation blade 322, for example in the vicinity of the inclined portion 302 directly below the toner supply port 311 (see FIG. 11, region C), and in this portion toner tends to accumulate and solidify. When toner further accumulates, a mass of toner forms (toner bridging), which blocks the toner supply port 311. When toner bridging occurs, toner flow deteriorates, and supply of toner to the toner hopper 30 deteriorates.

Further, when toner is left in the toner hopper 30 without being used for a long period of time, bulk density of the toner gradually increases due to weight of the toner itself, minute vibrations during operation of the image forming device, or the like, and in particular agglomeration tends to occur in the lowest portions of the toner hopper 30 (lowest portion of the cylinder bottom surface portion 301). Conventionally, the agitation blade 322 is formed of a flexible resin film such as a PET film, and therefore when agglomeration of toner in the lowest portion (region D) progresses there is a point at which the portion cannot be sufficiently agitated and the agitation blade 322 merely passes over the mass of toner in a deformed state. Further, agglomerated toner in region E adhered to the agitation blade 322 is not easily broken up merely by rotating the agitation blade 322.

However, a toner mass in a toner bridging portion in the vicinity of the toner supply port and in other portions is merely agglomerated toner, and therefore can be broken up by applying a certain extent of vibration or shock.

Thus, according to the present embodiment, the vibration plate 36 is provided. FIG. 5A to FIG. 5F are schematic diagrams illustrating vibration of the vibration plate 36 according to rotation of the agitation blade 322 of the agitator 32.

Figure 5D:
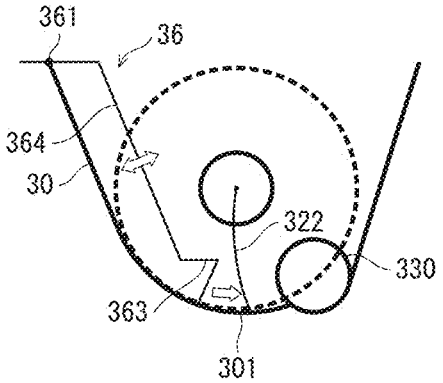
Figure 5B:
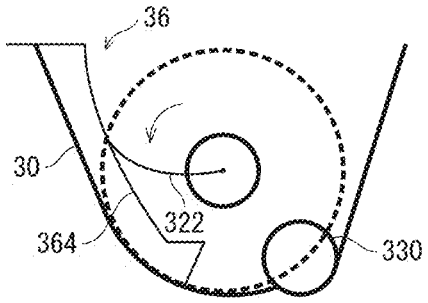
Figure 5E:
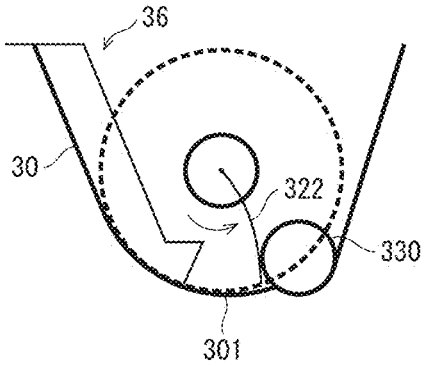

First, in FIG. 5A, the agitation blade 322 is rotated in the arrow direction (counterclockwise), the tip of the agitation blade 322 comes into contact with a central portion 364 of the vibration plate 36, and the vibration plate 36 is deformed (FIG. 5B).

As the tip of the agitation blade 322 approaches the engagement protrusion 363, the agitation blade 322 further deforms, accumulating elastic energy, and pushes the central portion 364 of the vibration plate 36, finally coming into contact with the engagement protrusion 363 (FIG. 5C); subsequently, the agitation blade 322 springs back as the tip passes over the ridge line 3631 of the engagement protrusion 363 (FIG. 5D).

When the tip of the agitation blade 322 springs back due to the engagement protrusion 363, elastic energy accumulated in the agitation blade 322 is released all at once, and the resulting restoring force imparts an impact on toner accumulated on the agitation blade 322 and centered at the bottom portion of the toner hopper 30, making breaking up of agglomerated toner possible. Immediately before the agitation blade 322 springs back, the engagement protrusion 363 acts to scrape off a portion of toner accumulated on the agitation blade 322, which also helps break up toner in region E.

Thus, in order to effectively break up toner in the bottom portion of the toner hopper 30 via restoring force of the agitation blade 322, position of the engagement protrusion 363 for causing the agitation blade 322 to spring back is preferably directly before the bottom portion of the toner hopper 30 in the rotation direction of the agitation blade 322.

In addition, at the time the tip of the agitation blade 322 springs back due to the engagement protrusion 363, the vibration plate 36 in a state of deformation bent toward the inner wall of the toner hopper 30 also springs back, and this elastic force acts to return the vibration plate 322 to its original state. At this time, the central portion 364 and the lower end portion 362 vibrate strongly with the fixed end of the upper end portion 361 as a base point, acting on stored toner of the toner bridging portion and other portions, accordingly breaking up agglomerated toner.

Figure 5C:
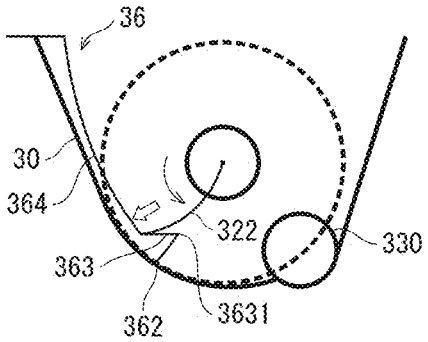
Figure 5F:
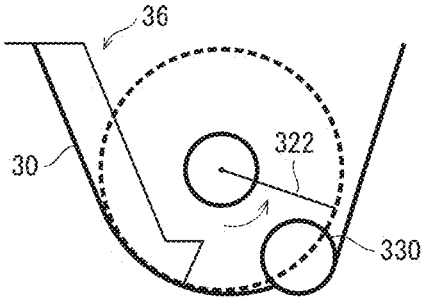

Subsequently, the tip of the agitation blade 322 comes into contact with the conveyance pipe 330 (FIG. 5E), and after springing back returns to its original rotation orbit (FIG. 5F).

Figure 6A:
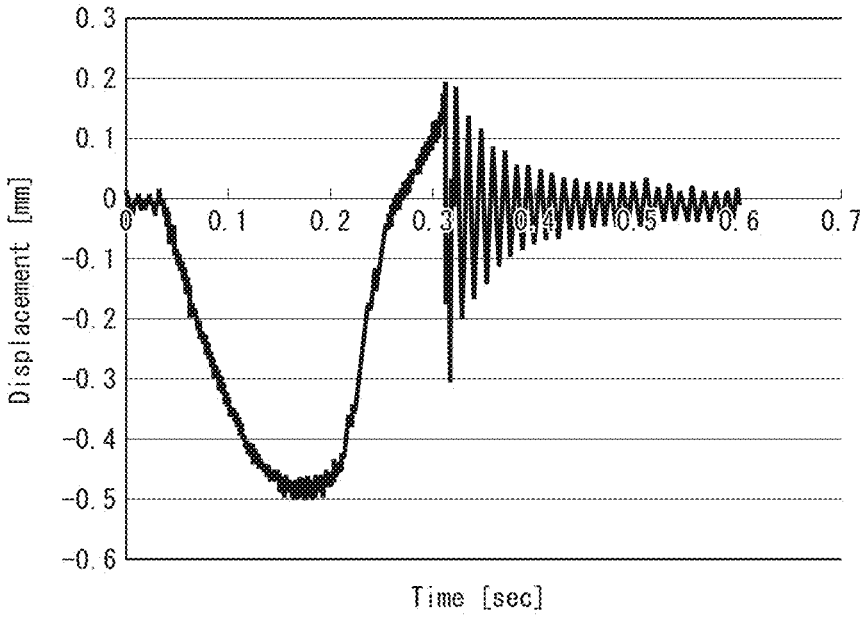
FIG. 6A is a graph obtained by measuring vibration of the vibration plate of an embodiment when the agitation member comes into contact with the vibration plate.

FIG. 6A is a graph illustrating magnitude of vibration of the vibration plate 36 at the time when the spring back action described above occurs, measured at a point P near the toner bridge portion of the central portion 364 of the vibration plate 36 in FIG. 5A.

The horizontal axis represents elapsed time in seconds and the vertical axis represents displacement in millimeters from an initial position. Negative displacement indicates displacement towards a wall surface of the toner hopper 30 and positive displacement indicates displacement away from the wall surface of the toner hopper 30.

As indicated in the graph, the vibration plate 36 is most displaced (−0.5 mm) when the tip of the agitation blade 322 reaches the engagement protrusion 363, and displacement changes greatly from −0.5 mm to +0.2 mm at the moment when the agitation blade 322 springs back, after which the vibration plate 36 vibrates, the vibration gradually attenuating. This vibration breaks up toner bridging in the vicinity of the toner supply port 311. According to these experiment results, maximum displacement at point P of the vibration plate 36 towards the wall surface of the toner hopper 30 is 0.5 mm, and therefore size of a gap g between the central portion 364 of the vibration plate 36 and the wall surface of the toner hopper 30 is preferably at least 0.5 mm.

However, as long as the gap g is not zero, the central portion 364 can vibrate to some extent, and therefore there is an effect of breaking up toner in each region from C to E to improve fluidity. Optimum size of the gap g is determined by experiments or the like, taking into consideration thickness of the vibration plate 36 and pressing force of the agitation blade 322.

Figure 6B:
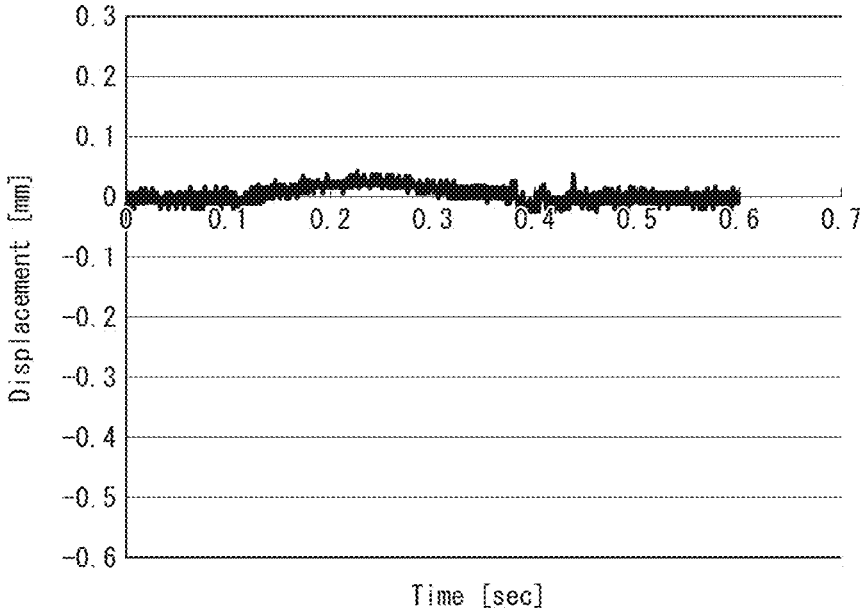
FIG. 6B is a graph obtained by measuring vibration of the vibration plate when the agitation member comes into contact with the vibration plate, in a case in which there is no gap between the vibration plate and a toner storage inner wall.

On the other hand, as a reference example, FIG. 6B is a graph illustrating displacement at the point P when a gap is not provided between the vibration plate 36 and the wall surface of the toner hopper 30.

As illustrated in FIG. 6B, displacement of the vibration plate 36 is at maximum approximately 0.04 mm, which is almost equivalent to no vibration and does not lead to breaking up of toner bridging. This illustrates the importance of providing a gap between the central portion 364 of the vibration plate 36 and the wall surface of the toner hopper 30.

Figure 7:
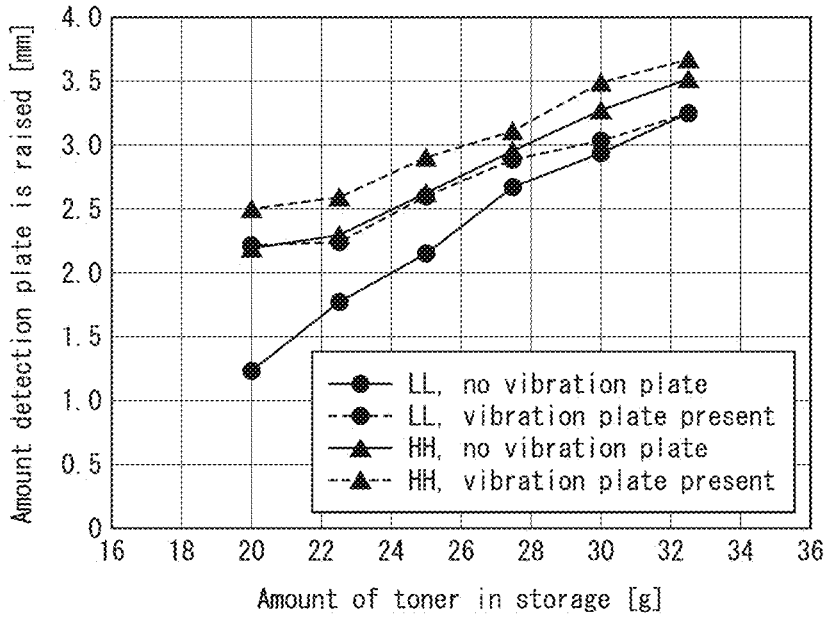
FIG. 7 is a graph indicating that fluidity of toner is increased and bulk of toner amount under a toner amount detection plate is increased according to the embodiment.

FIG. 7 is a graph illustrating experimental results for demonstrating an effect of the vibration plate 36 according to the present embodiment.

In the graph, the horizontal axis indicates actual toner amount in grams in the toner hopper 30 (toner storage) and the vertical axis indicates an amount the detection plate 352 is raised in millimeters.

Further, polygonal lines connecting dots • indicate results of experiments in an LL environment (low temperature, low humidity environment; for example, a device interior temperature of 10° C. and relative humidity 15%), while polygonal lines connecting triangles ▲ indicate results of experiments in an HH environment (high temperature, high humidity environment; for example, a device interior temperature of 30° C. and relative humidity 85%).

Further, for each environment, broken lines indicate cases in which the vibration plate 36 of the present embodiment is provided and solid lines indicate cases in which the vibration plate 36 is not provided.

The measured values of amounts that the detection plate rises are values obtained by storing each amount of toner in the toner hopper 30 under the LL environment or HH environment for a long time, then agitating the toner for a defined amount of time (for example, 10 seconds).

As can be seen from the graph of FIG. 7, under the LL environment and under the HH environment, and in particular when stored toner is low, the rising amount of the detection plate 352 is larger when the vibration plate 36 is provided (broken lines) than when the vibration plate 36 is not provided (solid lines).

This is understood to be because vibration of the vibration plate 36 and restoring force of the agitation blade 322 when the agitation blade 322 springs back due to the engagement protrusion 363 of the vibration plate 36 break up toner agglomerated in the vicinity of the toner supply port 311, the bottom surface portion 301 of the toner hopper 30, and the agitation blade 322, increasing fluidity of the toner and thereby increasing toner amount directly below the detection plate 352.

This was also confirmed by cutting open the toner hopper 30 and visually confirming toner state therein.

According to the present embodiment, merely by providing the vibration plate 36, which has a simple configuration, in a conventional toner replenishing device, toner bridging occurring in the vicinity of a toner supply port or the like due to long storage periods, and agglomeration occurring at the bottom surface portion 301 or the like of the toner hopper 30, is effectively broken up by vibration and impact occurring when the vibration plate 36 and the agitation blade 322 spring back, improving fluidity and enabling smoother and more efficient toner replenishment.

Springing back of the vibration plate 36 need not be caused by the tip of the agitation blade 322. For example, length of the agitation blade 322 may be extended such that any portion of the agitation blade 322 is in contact with the vibration plate 36.

<Modifications>

Although the present invention has been described based on an embodiment, the present invention is of course not limited to the embodiment described, and the following modifications are possible.

(1) According to the embodiment described above, the vibration plate 36 is a stainless steel plate having a thickness of 0.05 mm and the same width as the toner supply port, and is disposed directly below the toner supply port.

(1-1) Thickness of Vibration Plate 36

Figure 8:
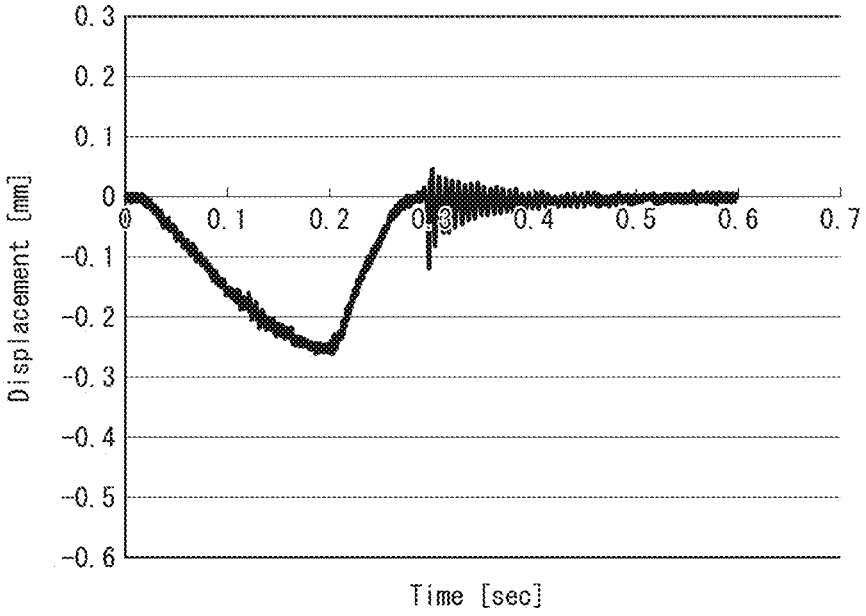
FIG. 8 is a graph indicating vibration of the vibration plate when thickness of the vibration plate is 0.1 mm.

FIG. 8 is a graph indicating displacement at the point P when the same experiment described with reference to FIG. 6A is performed on the vibration plate 36 having a thickness of 0.1 mm. When thickness is increased in this way, the range of vibration decreases. When thickness is increased beyond 0.1 mm, the range of vibration further decreases, and an effect of breaking up agglomerated toner cannot be expected, and therefore thickness of the vibration plate 36 is preferably equal to or less than 0.1 mm. A lower limit of thickness is preferably about 0.03 mm. When thickness is decreased below this, elastic force of the vibration plate 36 becomes smaller, and after deformation by the agitation blade 322 the vibration plate 36 does not return to its original form and does not vibrate.

(1-2) Position and Width of Vibration Plate 36

For the purpose of breaking up toner bridging formed in the vicinity of the toner supply port 311 via vibration of the vibration plate 36, the vibration plate 36 is preferably disposed directly below the toner supply port 311, as the embodiment is described above, and in this case width of the vibration plate 36 is preferably the same as that of the toner supply port 311.

Width of the vibration plate 36 is not limited to being the same width as the toner supply port, but if width of the vibration plate 36 is made too large, rigidity becomes high and it becomes difficult to deform when the agitation blade 322 comes into contact. Thus, a person having ordinary skill in the art can appropriately determine an upper limit of width of the vibration plate 36 that achieves desired vibration by conducting experiments or the like. Further, position of the vibration plate 36 may be shifted by some amount away from directly below the toner supply port 311 and still have the effect of breaking up toner bridging.

(1-3) Angle θ Between Lower End Portion 362 and Inner Wall Surface of Toner Hopper 30

According to the embodiment above, the angle θ between the outer surface of the lower end portion 362 of the vibration plate 36 and the inner wall surface of the toner hopper 30 (hereinafter, "contact angle θ") is set to 73° as an example, but may be any appropriate angle of 90° or less.

Figure 9A:
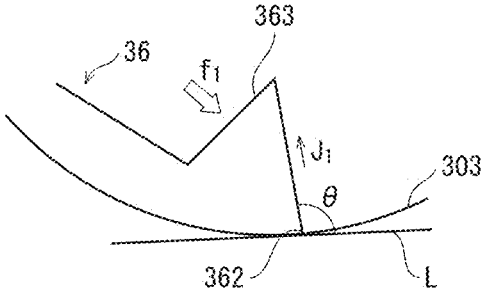
FIG. 9A and FIG. 9B are diagrams for describing preferred values for an angle between a lower end portion of the vibration plate and an inner wall of a toner hopper.
Figure 9B:
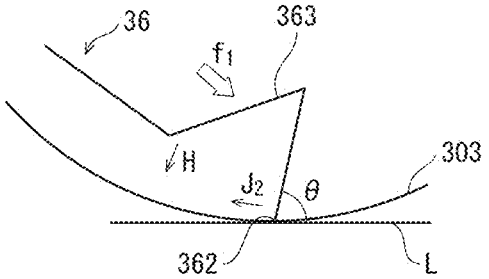

FIG. 9A and FIG. 9B are schematic diagrams of an enlarged portion around the engagement protrusion 363 where the tip of the agitation blade 322 contacts the engagement protrusion 363 as in FIG. 5C. FIG. 9A illustrates a case in which the contact angle θ exceeds 90°, and FIG. 9B illustrates a case in which the contact angle θ is within 90°. In FIG. 9A and FIG. 9B, a straight line L indicates a tangent line of the inner wall surface 303 of the toner hopper 30 at the position where the lower end portion 362 of the vibration plate 36 is in contact. In FIG. 9A and FIG. 9B, the agitation blade 322 is not illustrated.

As illustrated in FIG. 9A, when rotating, the tip of the agitation blade 322 comes into contact with a rising slope of the engagement protrusion 363, applying a force f1, rotating the lower end portion 362 clockwise, but when the contact angle θ is greater than 90° it is difficult for the contact portion of the lower end portion 362 in contact with the inner wall surface of the toner hopper 30 to move inward (clockwise), a reaction force acts in a direction J1, and the vibration plate 36 is not pushed down as expected.

In contrast, when the contact angle θ is 90° or less as illustrated in FIG. 9B, the contact portion of the lower end portion 362 in contact with the inner surface wall of the toner hopper 30 moves easily inward (clockwise) in a direction J2, decreasing an angle at the mountain fold, allowing the agitation blade 322 to easily push down the vibration plate 36 in a direction H.

When the amount the vibration plate 36 is pushed down is large, a reaction force when engagement with the agitation blade 322 is released is large, and sufficient vibration to break up agglomerated toner can be achieved.

Note that the 90° upper limit of the contact angle θ is a value relevant only when the agitation blade 322 is in contact with the engagement protrusion 363. As illustrated in FIG. 5B, when the agitation blade 322 is in direct contact and the central portion 364 of the vibration plate 36 is deformed, the position of the lower end portion 362 may move outward, and therefore in an initial state in which the agitation blade 322 is not in direct contact it is preferable to set the contact angle somewhat smaller than a target contact angle.

A lower limit of the contact angle θ is, for example, about 40°. A more specific value can be easily determined by a person having ordinary skill in the art through experiments or the like, in order to determine a necessary angle for the engagement protrusion 363 to cause the agitation blade 322 to spring back with sufficient force.

(1-4) Material of Vibration Plate 36

According to the embodiment described above, material of the vibration plate 36 is stainless steel, but the material is not limited to this example. Any metal that has similar properties to stainless steel (in particular elasticity) can be used.

(1-5) Shape of Engagement Protrusion 363

Shape of the engagement protrusion 363 is not limited to the mountain fold shape of the embodiment described above. As long as the tip of the agitation blade 322 is caused to spring back, another shape may be used. Further, another member may be attached to the vibration plate 36.

(2) According to the embodiment described above, a contour of the inner wall of the bottom portion of the toner hopper 30 on a plane orthogonal to the rotation axis of the agitator 32 is a circular arc, but the contour is not necessarily a perfect arc. It suffices that the contour is a downward curve, and the agitation blade 322 has a length in the radial direction such that its tip contacts the bottom portion farthest from a center of rotation.

(3) According to the embodiment described above, a toner replenishing device between a toner bottle and a developer unit is described. However, in a small printer, for example, it is difficult to provide sufficient space to accommodate a toner bottle, and therefore a configuration may be adopted in which the toner bottle is eliminated and the toner hopper itself replaces the toner bottle and is itself replaceable in an image forming device main body.

Figure 10:
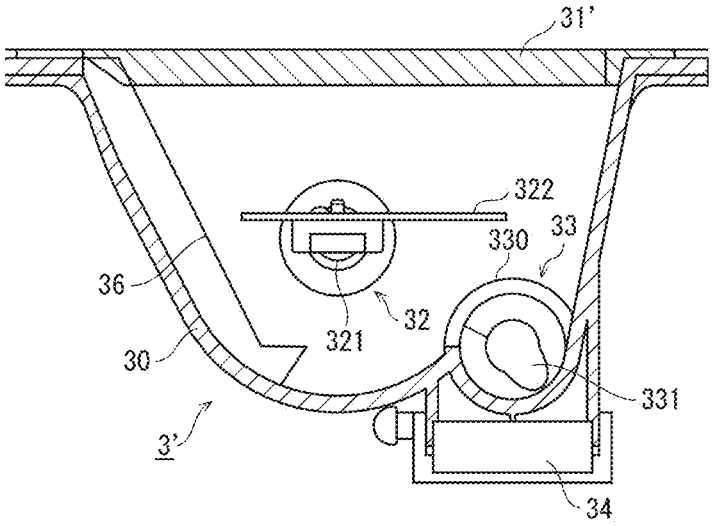
FIG. 10 is a diagram illustrating a modification of a case in which the present invention is applied to a toner storage bottle.

FIG. 10 illustrates such a configuration of a toner replenishing device 3'.

Essentially, the toner replenishing device 3' has the same configuration as the toner replenishing device 3 illustrated in FIG. 2, but a lid 31' does not have a toner supply port, and the toner detector 35 is also not required. Although not illustrated, a coupling for connecting with a drive shaft of a drive device of an image forming device main body when the toner replenishing device 3 is attached to the image forming device main body is provided to a portion of the rotation shaft 321 of the agitator 32 protruding from the toner hopper 30.

Even with such a configuration, agglomeration of toner in the toner hopper 30 can be eliminated and flow improved through vibration of the vibration plate 36 and restoring force of the agitation blade 322 caused by springing back of the agitation blade 322 due to the vibration plate 36, and therefore toner can be smoothly and efficiently supplied to a developer unit.

(4) According to the embodiment described above, a toner replenishing device that replenishes only toner as a developer is described. However, for example, among developer units that use dual-component developer, a trickle-type developer device may discharge old carrier and gradually replace it with new carrier in order to prevent carrier deterioration, and such carrier may be included for replenishment in addition to toner.

(5) The present invention may be regarded as relating to a developer replenishment device for replenishing developer such as toner, and also as relating to a developer device provided with the developer replenishment device, and also as relating to an image forming device provided with the developer device.

(6) According to the embodiment described above, an example image forming device is described as a tandem type color copying machine, but the invention is applicable to any image forming device equipped with a developer replenishment device, such as a facsimile device, printer, or monochrome image forming device.

(7) Further, content of the embodiment described above and modifications thereof may be combined in any reasonable combination.

Although one or more embodiments of the present invention have been described and illustrated in detail, the disclosed embodiments are made for the purposes of illustration and example only and not limitation. The scope of the present invention should be interpreted by the terms of the appended claims.

What is claimed is:

1. A developer replenishment device that replenishes developer to a developer unit, the developer replenishment device comprising:

a storage for storing developer;

an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, the vibration plate is provided with an engagement protrusion disposed towards the free end of the vibration plate, the engagement protrusion engaging with the agitation member and causing the agitation member undergoing rotation to deform then spring back, a position at which the agitation member engages with the engagement protrusion is upstream of a supply member in the rotation direction of the agitation member;

the storage is between a developer storage bottle and the developer unit, temporarily stores developer, and includes a supply port to receive developer from the developer storage bottle and a replenishment port to replenish developer to the developer unit, and the vibration plate, through vibrations caused by contact with the agitation member, prevents bridging of developer at the supply port.

2. The developer replenishment device of claim 1, wherein the vibration plate is disposed directly below the supply port.

3. The developer replenishment device of claim 2, wherein width of the vibration plate in a direction parallel to a rotation axis of the agitation member is the same as width of the supply port in the same direction.

4. The developer replenishment device of claim 1, wherein the engagement protrusion of the vibration plate is immediately before a lowest portion of the storage in the rotation direction of the agitation member.

5. The developer replenishment device of claim 1, wherein a contour of an inner wall of the bottom portion of the storage in a cross section orthogonal to the rotation axis of the agitation member is curved outward away from the rotation axis, and length in a radial direction of the agitation member is at least sufficient to contact a farthest portion of the inner wall of the bottom portion of the storage from the rotation axis during rotation.

6. The developer replenishment device of claim 1, wherein the gap between the vibration portion of the vibration plate and the inner wall of the storage is at least 0.5 mm.

7. The developer replenishment device of claim 1, wherein thickness of the vibration plate is 0.1 mm or less.

8. A developer replenishment device that replenishes developer to a developer unit, the developer replenishment device comprising:

a storage for storing developer;

an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, and the vibration plate is provided with an engagement protrusion disposed towards the free end of the vibration plate, the engagement protrusion engaging with the agitation member and causing the agitation member undergoing rotation to deform then spring back, wherein a portion of the engagement protrusion of the free end of the vibration plate has a mountain fold shape pointing towards the interior of the storage, the portion of the engagement protrusion having a ridge line parallel to the rotation axis of the agitation member.

9. The developer replenishment device of claim 8, wherein at least when the agitation member is in contact with the engagement protrusion, an angle between an outer side surface of the portion of the free end of the vibration plate in the mountain fold shape and an inner wall surface of the storage is 90° or less.

10. A developing device comprising:

a developer unit; and a developer replenishment device that supplies developer to the developer unit, the developer replenishment device comprising:

a storage for storing developer;

an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, the vibration plate is provided with an engagement protrusion disposed towards the free end of the vibration plate, the engagement protrusion engaging with the agitation member and causing the agitation member undergoing rotation to deform then spring back, a position at which the agitation member engages with the engagement protrusion is upstream of a supply member in the rotation direction of the agitation member;

the storage is between a developer storage bottle and the developer unit, temporarily stores developer, and includes a supply port to receive developer from the developer storage bottle and a replenishment port to replenish developer to the developer unit, and the vibration plate, through vibrations caused by contact with the agitation member, prevents bridging of developer at the supply port.

11. An image forming device comprising:

a developing device;

a transfer unit for transferring an image formed by the developing device onto a recording sheet; and a fixing unit for fixing onto the recording sheet the image transferred by the transfer unit, wherein the developing device comprises:

a developer unit; and a developer replenishment device that supplies developer to the developer unit, the developer replenishment device comprising:

a storage for storing developer;

an agitation member that has a blade shape, disposed in the storage and rotationally driven to agitate the developer in the storage; and a vibration plate disposed in the storage and extending from a top portion of the storage towards a bottom portion of the storage along a rotation direction of the agitation member, the vibration plate including a vibration portion that vibrates due to contact with the agitation member undergoing rotation, wherein a top end of the vibration plate is a fixed end and a bottom end of the vibration plate is a free end, and there is a gap between the vibration portion and an inner wall of the storage, the vibration plate is provided with an engagement protrusion disposed towards the free end of the vibration plate, the engagement protrusion engaging with the agitation member and causing the agitation member undergoing rotation to deform then spring back, a position at which the agitation member engages with the engagement protrusion is upstream of a supply member in the rotation direction of the agitation member;

the storage is between a developer storage bottle and the developer unit, temporarily stores developer, and includes a supply port to receive developer from the developer storage bottle and a replenishment port to replenish developer to the developer unit, and the vibration plate, through vibrations caused by contact with the agitation member, prevents bridging of developer at the supply port.

* * * * *